US011649640B2

(12) United States Patent
Kirchner

(10) Patent No.: US 11,649,640 B2
(45) Date of Patent: May 16, 2023

(54) INTERLOCKING TILES

(71) Applicant: Jahnke & Sons Construction, Inc., Overland Park, KS (US)

(72) Inventor: Joseph Peter Kirchner, Kansas City, MO (US)

(73) Assignee: Jahnke & Sons Construction, Inc., Overland Park, KS (US)

( * ) Notice: Subject to any disclaimer, the term of this patent is extended or adjusted under 35 U.S.C. 154(b) by 0 days.

(21) Appl. No.: 17/224,085

(22) Filed: Apr. 6, 2021

(65) Prior Publication Data

US 2022/0316218 A1 Oct. 6, 2022

(51) Int. Cl.

| | |
|---|---|
| ***E04F 13/08*** | (2006.01) |
| ***E04F 13/073*** | (2006.01) |
| ***E04B 1/94*** | (2006.01) |
| ***A62C 99/00*** | (2010.01) |
| *E04F 13/14* | (2006.01) |

(52) U.S. Cl.

CPC ..... *E04F 13/0889* (2013.01); *A62C 99/0081* (2013.01); *E04B 1/942* (2013.01); *E04F 13/0733* (2013.01); *E04F 13/0803* (2013.01); *E04F 13/14* (2013.01)

(58) Field of Classification Search

None

See application file for complete search history.

(56) References Cited

U.S. PATENT DOCUMENTS

| | | | | |
|---|---|---|---|---|
| 2,053,843 | A * | 9/1936 | Rossi | E04F 13/0803 52/27 |
| 2,341,777 | A | 2/1944 | Hensel | |
| 4,252,292 | A * | 2/1981 | Armas | B28B 7/22 249/27 |
| 4,638,618 | A * | 1/1987 | Iesaka | B44C 1/28 52/509 |
| 5,457,921 | A * | 10/1995 | Kostrzecha | E06B 9/02 52/798.1 |
| 5,497,728 | A * | 3/1996 | Watanabe | A01K 1/033 119/452 |
| 5,692,343 | A * | 12/1997 | Matsuura | E01C 5/08 52/125.2 |
| 8,596,001 | B2 * | 12/2013 | Harris | E04F 15/02172 52/302.1 |
| 8,601,959 | B2 | 12/2013 | His et al. | |
| 8,844,225 | B2 * | 9/2014 | Harris | E04F 15/02172 52/302.1 |
| 9,382,710 | B1 * | 7/2016 | Diaz | E04B 2/7416 |
| 2004/0221518 | A1 * | 11/2004 | Westra | E04B 1/94 52/79.1 |

(Continued)

FOREIGN PATENT DOCUMENTS

KR 20130090152 A * 8/2013

*Primary Examiner* — Joshua K Ihezie

(74) *Attorney, Agent, or Firm* — Avek IP, LLC

(57) ABSTRACT

A tile system for a burn room includes a plurality of interlocking surface tiles, each surface tile having an upper portion and a lower portion. The lower portion extends beyond at least a portion of a perimeter of the upper portion to define a flange. The system further includes a plurality of interlocking corner tiles configured to interact with at least one of the plurality of surface tiles; and a bracket system for securing the plurality of surface tiles and the plurality of corner tiles to a surface.

19 Claims, 11 Drawing Sheets

(56) References Cited

U.S. PATENT DOCUMENTS

| | | | | |
|---|---|---|---|---|
| 2005/0210784 | A1* | 9/2005 | Hahn | E04F 19/0495 52/287.1 |
| 2013/0047533 | A1* | 2/2013 | Diener | E04F 19/04 52/287.1 |
| 2013/0160639 | A1* | 6/2013 | Lee | F41H 5/0442 264/603 |
| 2015/0308476 | A1* | 10/2015 | Black | F16B 7/0486 403/205 |
| 2016/0252208 | A1* | 9/2016 | Katz | A47B 57/46 211/195 |
| 2017/0066222 | A1* | 3/2017 | Hynes | C04B 35/76 |
| 2017/0067253 | A1* | 3/2017 | Végiard | E04B 9/18 |
| 2017/0261022 | A1* | 9/2017 | Schirmer | A47B 81/00 |
| 2017/0335575 | A1* | 11/2017 | Diener | E04F 19/0486 |
| 2021/0324629 | A1* | 10/2021 | Brinton | E04B 1/80 |

* cited by examiner

INTERLOCKING TILES

FIELD OF THE DISCLOSURE

The disclosure relates generally to the field of burn rooms. More specifically, the disclosure relates to burn rooms employing a plurality of interlocking tiles.

SUMMARY

The following presents a simplified summary of the invention in order to provide a basic understanding of some aspects of the invention. This summary is not an extensive overview of the invention. It is not intended to identify critical elements of the invention or to delineate the scope of the invention. Its sole purpose is to present some concepts of the invention in a simplified form as a prelude to the more detailed description that is presented elsewhere herein.

In one embodiment, a tile system for a burn room includes a plurality of interlocking surface tiles, each surface tile having an upper portion and a lower portion. The lower portion extends beyond at least a portion of a perimeter of the upper portion to define a flange. The system further includes a plurality of interlocking corner tiles configured to interact with at least one of the plurality of surface tiles; and a bracket system for securing the plurality of surface tiles and the plurality of corner tiles to a surface.

In another embodiment, a tile system for a burn room, includes a plurality of surface tiles, each surface tile comprising a main body having a top face and a bottom face, and a flange extending substantially around a perimeter of the main body, wherein a bottom face of the flange is level with the bottom face of the main body. Each tile is configured to be arranged in an upward-facing orientation and a downward-facing orientation. A first tile of the plurality of tiles is arranged in the upward-facing orientation in an installed configuration. A second tile of the plurality of tiles is arranged in the downward-facing orientation in the installed configuration. In the installed configuration, the flange of the first tile is substantially adjacent the flange of the second tile.

In still another embodiment, a method of assembling a burn room, includes (a) providing a plurality of interlocking surface tiles, each surface tile comprising a main body having a top face and a bottom face and a flange extending substantially around a perimeter of the main body, wherein a bottom face of the flange is level with the bottom face of the main body; (b) positioning a first tile of the plurality of tiles substantially adjacent a surface in an upward facing orientation; and (c) positioning a second tile of the plurality of tiles substantially adjacent the surface and the first tile in a downward facing orientation. When the second tile is positioned substantially adjacent the first tile, the flange of the second tile at least partially overlaps the flange of the first tile.

BRIEF DESCRIPTION OF THE SEVERAL VIEWS OF THE DRAWINGS

Illustrative embodiments of the present disclosure are described in detail below with reference to the attached drawing figures.

DETAILED DESCRIPTION

Conventional burn rooms are known in the art. These conventional burn rooms typically consist of walls lined with one or more tiles having fire-resistant and/or fire-retardant properties. With these tiles, the rooms are usable for firefighting training and other similar tasks that require spaces that are resistant to heat or flames. One issue with conventional fire room tiles is that they require a large section (e.g., an entire wall) of tiles to be placed at one time. Thus, installation or repair of these tiles takes significant time and effort. Even if only a single tile needs to be replaced, multiple tiles must be uninstalled in order to remove the tile at issue. To mitigate this issue, prior art burn room tiles are often oversized (e.g., two by four feet, eighteen inches by eighteen inches, et cetera). Oversized burn room tiles reduce the number of tiles required for a given space, thus lowering the amount of time it takes to install or replace those tiles. Even so, these larger tiles are cumbersome and more costly to replace when they inevitably incur damage. The larger tiles are also more susceptible to expansion/contraction under extreme temperatures than smaller tiles. Further, conventional tiles require complex and/or expensive design features to allow the tiles to be sufficiently secured to the fire room surfaces. Embodiments of the disclosure relate to burn room tile systems and methods that, at least in part, resolve the issues with using traditional burn room tiles.

Figure 7A:
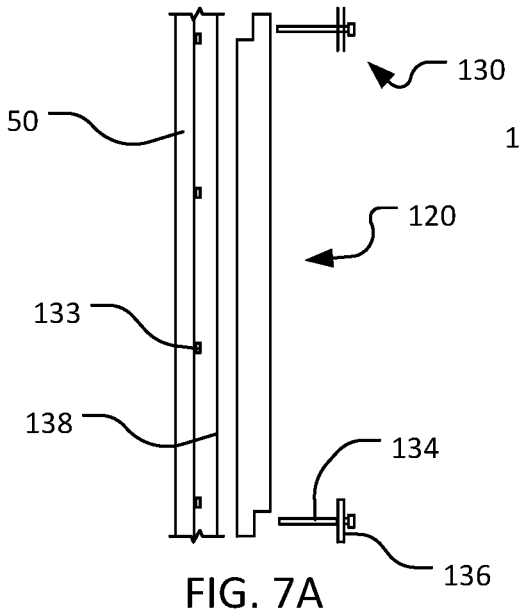
FIG. 7A is a side view of a bracket system for securing interlocking corner tiles to a surface according to embodiments of the invention.
Figure 7B:
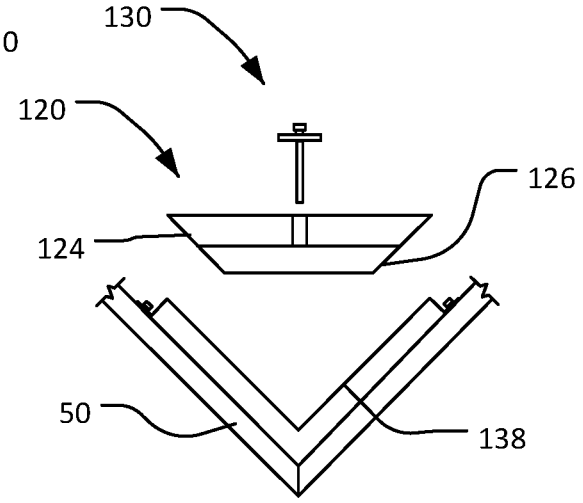
FIG. 7B is a top view of the bracket system of FIG. 7A.
Figure 7C:
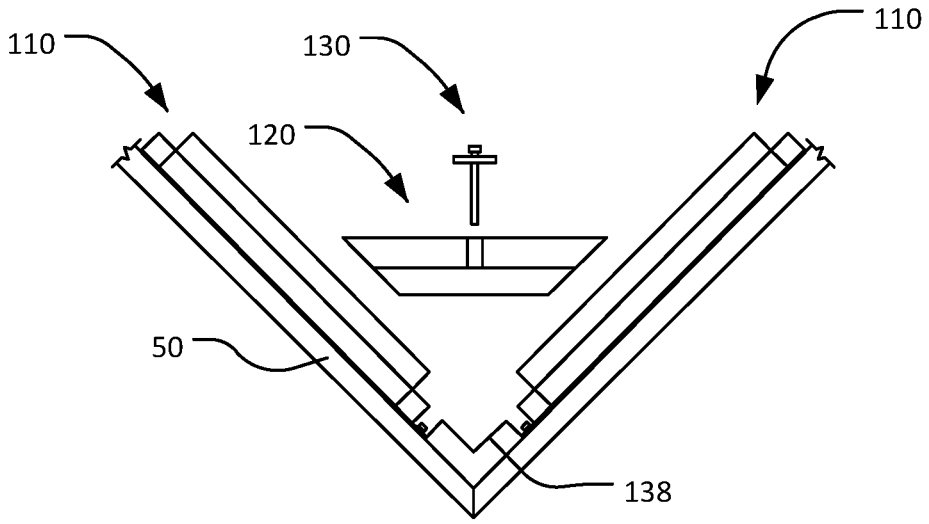
FIG. 7C is a top view of the bracket system of FIG. 7A ready for install with interlocking tiles secured to a surface.
Figure 8:
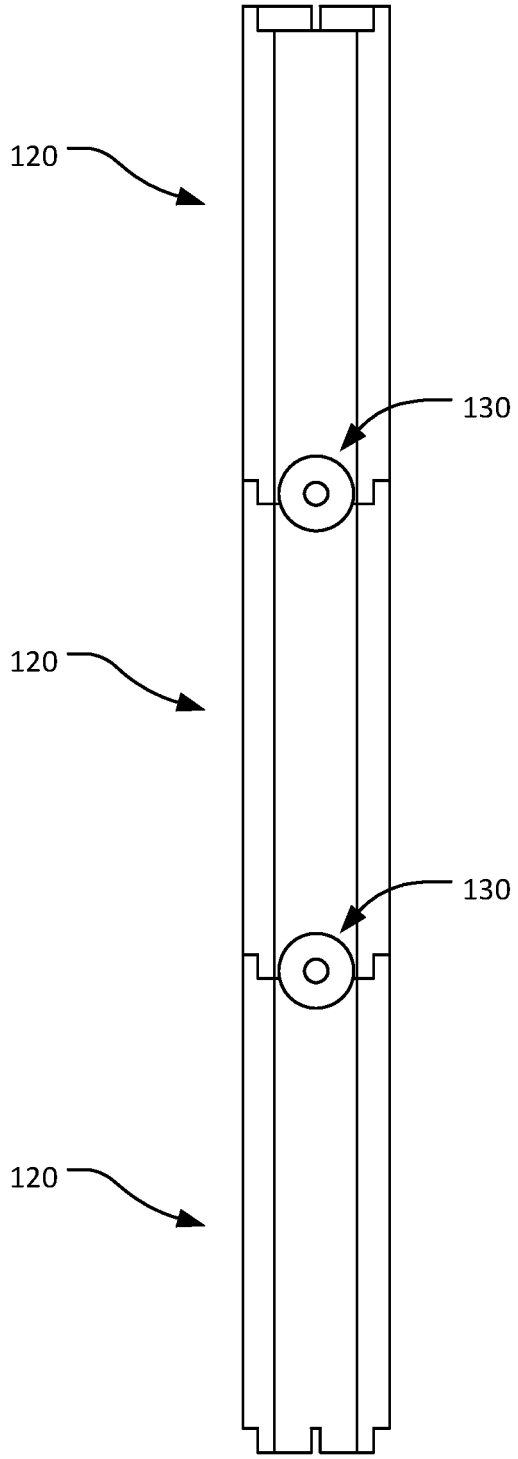
FIG. 8 is a front view of interlocking corner tiles with a bracket system according to embodiments of the invention.
Figure 9:
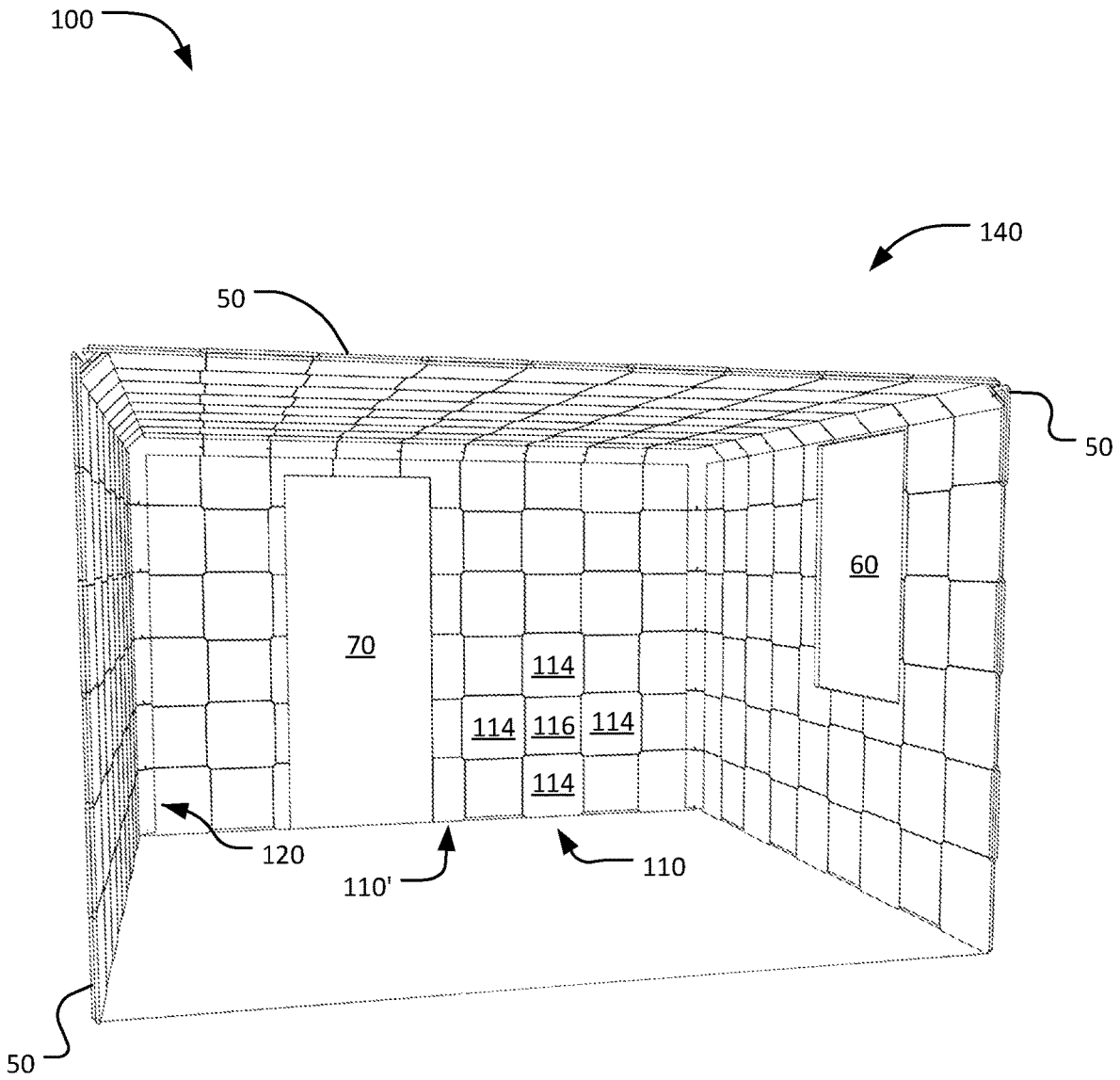
FIG. 9 illustrates a burn room employing a plurality of interlocking tiles according to embodiments of the invention.
Figure 10A:
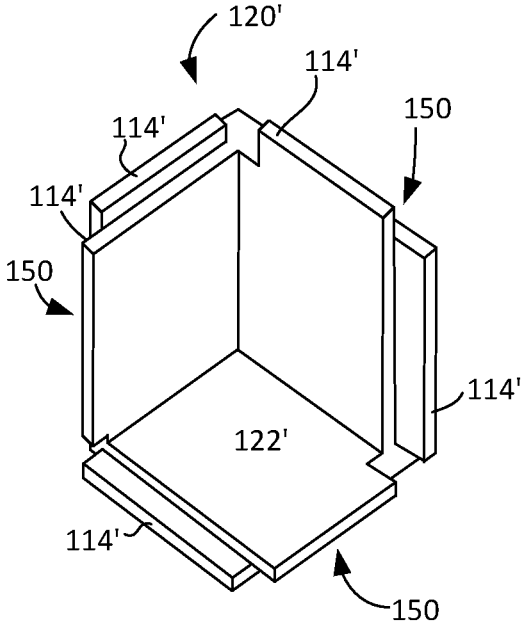
FIG. 10A is a perspective view of a corner tile according to embodiments of the invention.
Figure 10B:
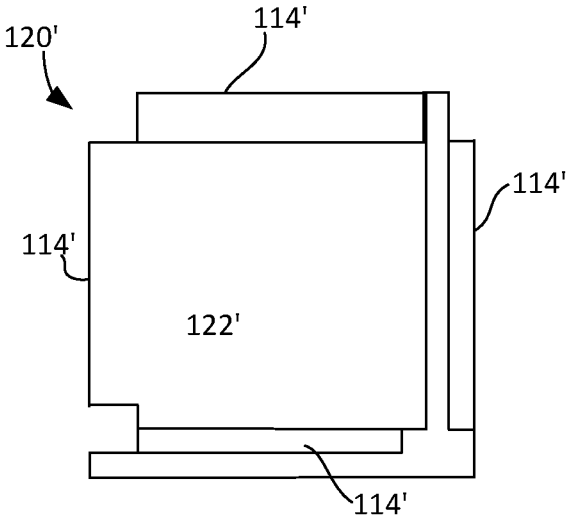
FIG. 10B is a right side view of the corner tile of FIG. 10A.
Figure 10C:
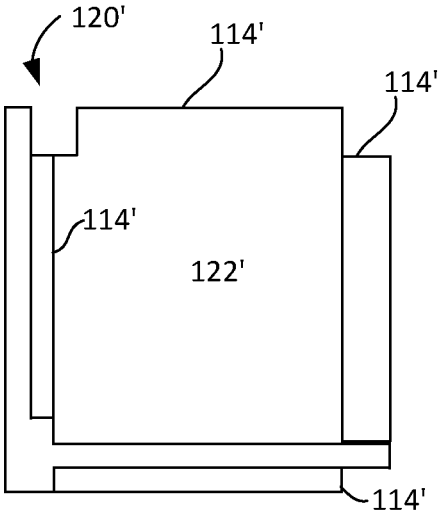
FIG. 10C is a left side view of the corner tile of FIG. 10A.
Figure 10D:
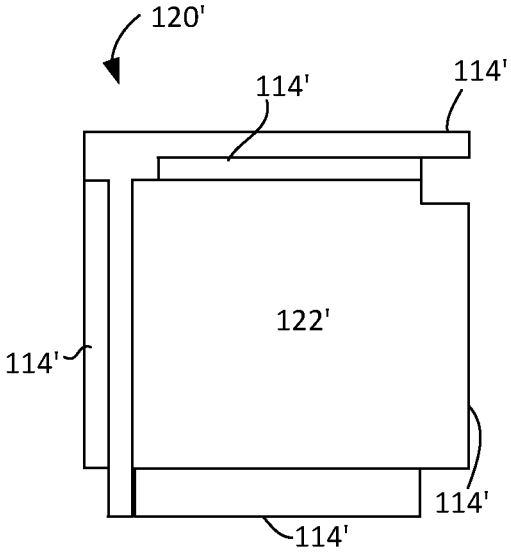
FIG. 10D a top view of the corner tile of FIG. 10A.

FIGS. 1-9 depict embodiments of interlocking tile systems 100 for use with a fire room 140 (FIG. 9). The interlocking tile system 100 may include a plurality of wall tiles 110 and a plurality of corner tiles 120, which may be secured to a surface using a plurality of brackets 130. In operation, the interlocking tile system 100 may provide a room with fire protection (e.g., by acting as a fire-resistant and/or fire-retardant overlay to the surface they are secured to). The interlocking nature of the system 100 may enable tile installation and replacement that is relatively quicker than the prior art. In embodiments, each tile of the system 100 may be individually replaced without also having to uninstall adjacent tiles.

FIGS. 1A-1D illustrate an interlocking wall tile 110 according to embodiments of the invention. Each wall tile 110 may include a tile body 112 having a generally square profile, though the tile 110 may have any shape. The tile body 112 has an upper portion 116 and a lower flange 114 vertically offset from the upper portion 116 and extending generally around the perimeter of the upper portion 116. Thus, each of the tiles may have what is referred to herein as an "inverted shiplap" design. In other words, the lower flange 114 may have a total width 114W that is larger than a width 116W of the upper portion 116. The flange 114 may be sized correspondingly with flange 114 of another tile 112, such that these flanges 114 overlap in an installed configuration as discussed in greater detail below.

To accommodate the inverted shiplap design of the interlocking tiles 110, the flange 114 of the body 112 may have chamfered corners 118. In some embodiments, the chamfered corners 118 are sized such that the flange 114 has an edge length 114E that is equal to the upper portion width 116W. In embodiments, the flange 114 may be broken around the perimeter of the upper portion 116 such that the flange 114 is devoid of corners as represented by the broken lines in FIG. 1C. With such configurations (e.g., chamfered corners or no corners), adjacent tiles 110 may be overlapped with little to no conflict therebetween. Similarly, a height 114H of the flange 114 and a height 116H of the upper portion 116 may be substantially equal to preclude conflict between overlapping tiles 110. In an example embodiment, the total flange width 114W may be about fifteen inches, and the flange 114 may extend about one inch from the perimeter of the upper portion 116.

The body 112 may, in embodiments, be casted, molded, or machined into shape. The body 112 may consist of any suitable fire-resistant or fire-retardant material now known or subsequently developed for tiles, such as polypropylene, polycarbonate, thermoplastic vulcanizate elastomers, et cetera. In embodiments, the body 112 may be formed of a calcium silicate material, which is known in the industry for its superior properties for burn rooms liners as compared to other burn room liner materials. Calcium silicate tiles are lighter yet exhibit greater flexural strength as compared to other tiles (9.7 lb/sf versus 18-25 lb/sf and 3000 psi versus 750-1200 psi, respectively). Such tiles also exhibit improved insulating capabilities, where the temperature at the face of the concrete with calcium silicate tiles is 226° F. with an ambient temperature of 1000° F. and 336° F. with an ambient temperature of 1500° F. This is a marked improvement over other tile materials, where the temperature of the face of the concrete ranges from 583° F. to over 900° F. at similar ambient conditions. Heat retention properties are also improved by calcium silicate tiles: at 1000° F. ambient temperature, calcium silicate tiles retain 4260 btu/sf, and at 1000° F., 7015 btu/sf. For comparison, other tiles retain anywhere from around 10,000 btu/sf to over 17,000 btu/sf under the same conditions. Other fireproofing materials may also be used, either alone or in combination with calcium silicate, to form the tiles 112. For example, while some embodiments of the tile 110 may inherently have fire-resistant or fire-retardant properties, in other embodiments, the tile 110 may alternatively or additionally be covered with a fire-resistant or fire-retardant coating.

Figure 1A:
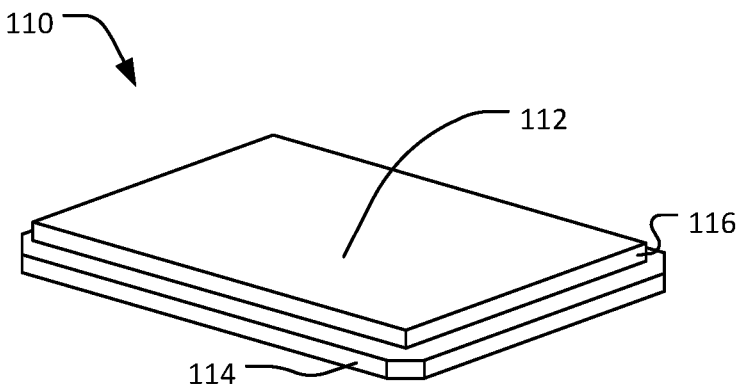
FIG. 1A is a perspective view of an interlocking tile according to embodiments of the invention.
Figure 1B:
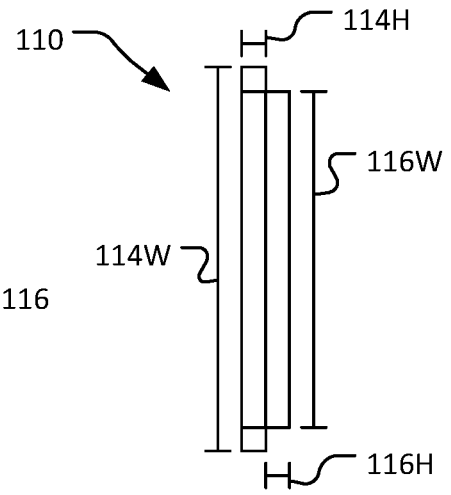
FIG. 1B is a side view of the interlocking tile of FIG. 1.
Figure 1C:
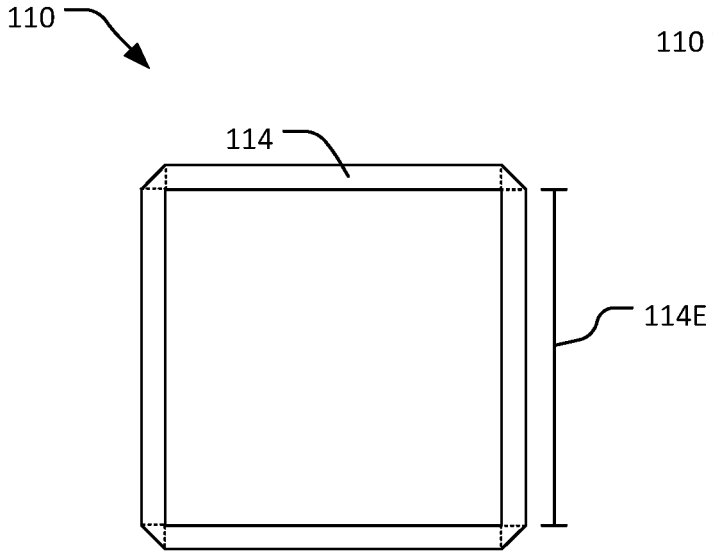
FIG. 1C is a front view of the interlocking tile of FIG. 1.
Figure 1D:
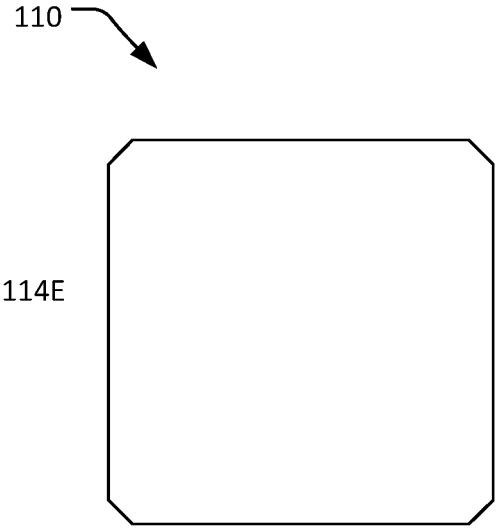
FIG. 1D is a rear view of the interlocking tile of FIG. 1.
Figure 2A:
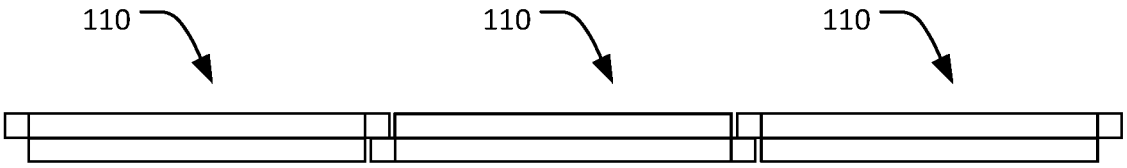
FIG. 2A is a side view of a system of interlocking tiles according to embodiments of the invention.
Figure 2B:
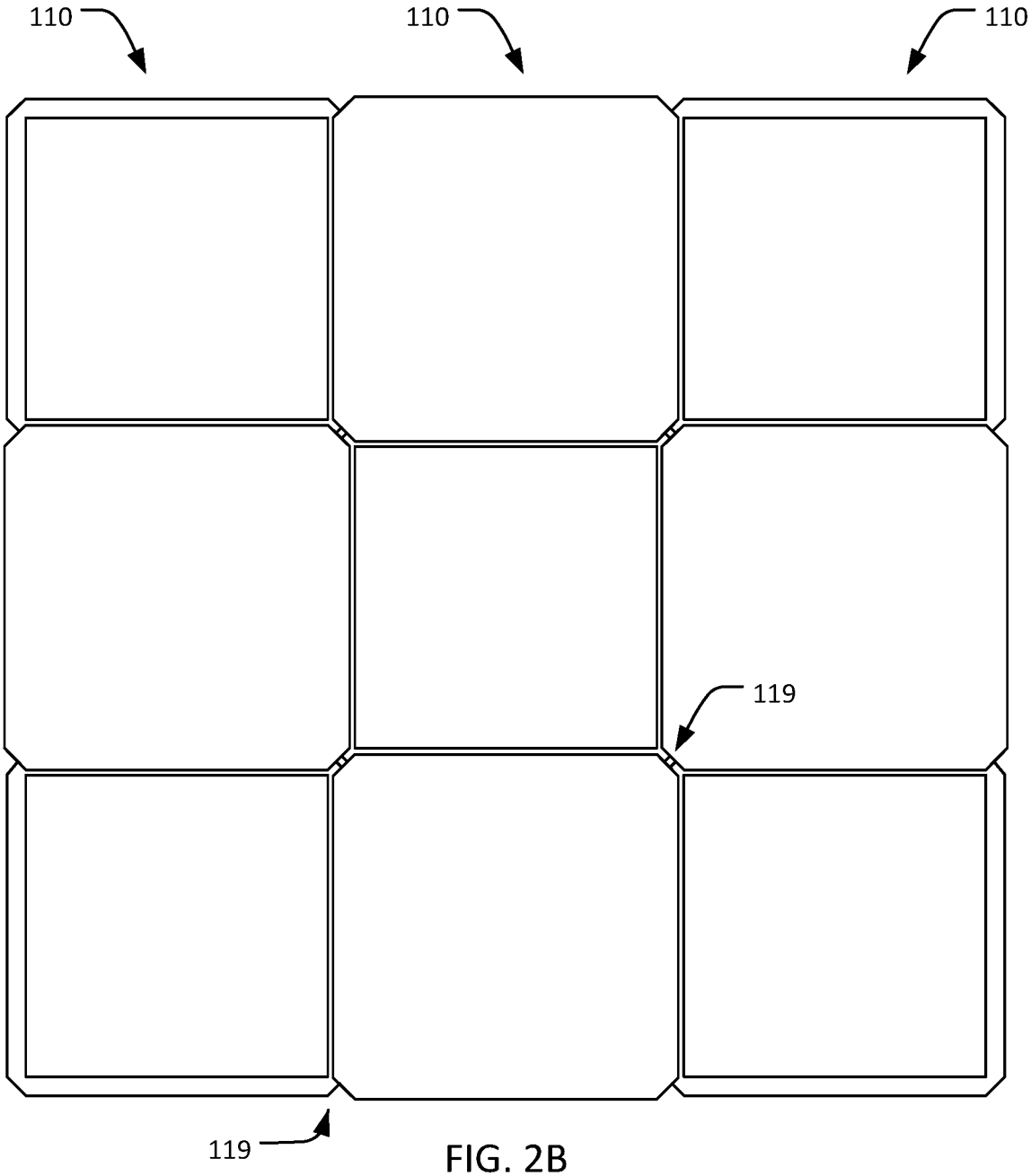
FIG. 2B is a front view of the system of interlocking tiles according to FIG. 2A.

Moving on, in operation, a downward facing tile 110 (FIG. 1D) is positioned over an adjacent upward facing tile 110 (FIG. 1C) such that their flanges 114 overlap, as shown in FIGS. 2A-2B. When assembled, an opening 119 (FIG. 2B) is defined between two or more tiles 110 such that the tiles 110 may be secured to the surface (e.g., a wall, a ceiling), as will be discussed below. Once secured in place, the overlapping tiles 110 may provide fire protection for the surface to which they are secured.

Figure 3A:
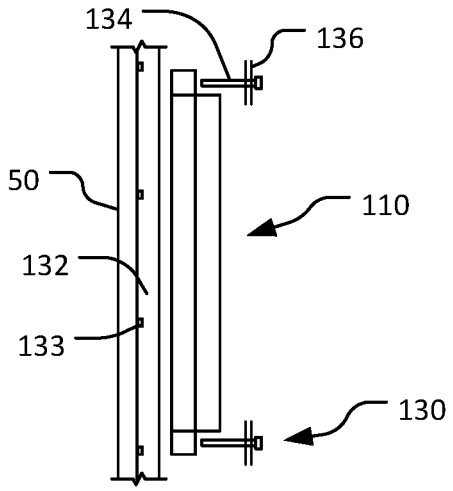
FIG. 3A is a side view of a bracket system for securing interlocking tiles to a surface according to embodiments of the invention.
Figure 3B:
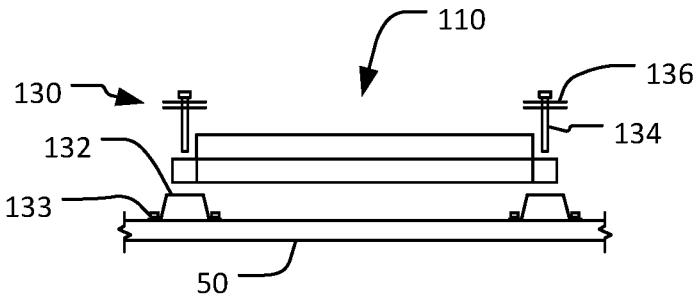
FIG. 3B is a top view of a bracket system for securing interlocking tiles to a surface according to embodiments of the invention.

The tiles 110 may not be secured directly to a surface such as a wall or ceiling. Rather, a bracket system may be utilized to dissociate the tiles 110 from the surface to provide an area of insulation (e.g., air) between the tiles 110 and the surface. FIGS. 3A-3B show an exemplary bracket system 130 for securing the interlocking tiles 110 to a surface (e.g., a wall 50). The bracket system 130 may include one or more decoupling channels 132 that together define a channel grid, a plurality of fasteners 133, a plurality of bolts 134, and one or more washers 136. The channel 132 may be any suitable channel now known or subsequently developed. The channel 132 may be secured to the wall 50 using fasteners 133 and may be further configured to receive the bolts 134, e.g., by having a plurality of apertures defined along its length at predetermined locations, or a slotted hole running along a length of the channel 132.

Figure 4:
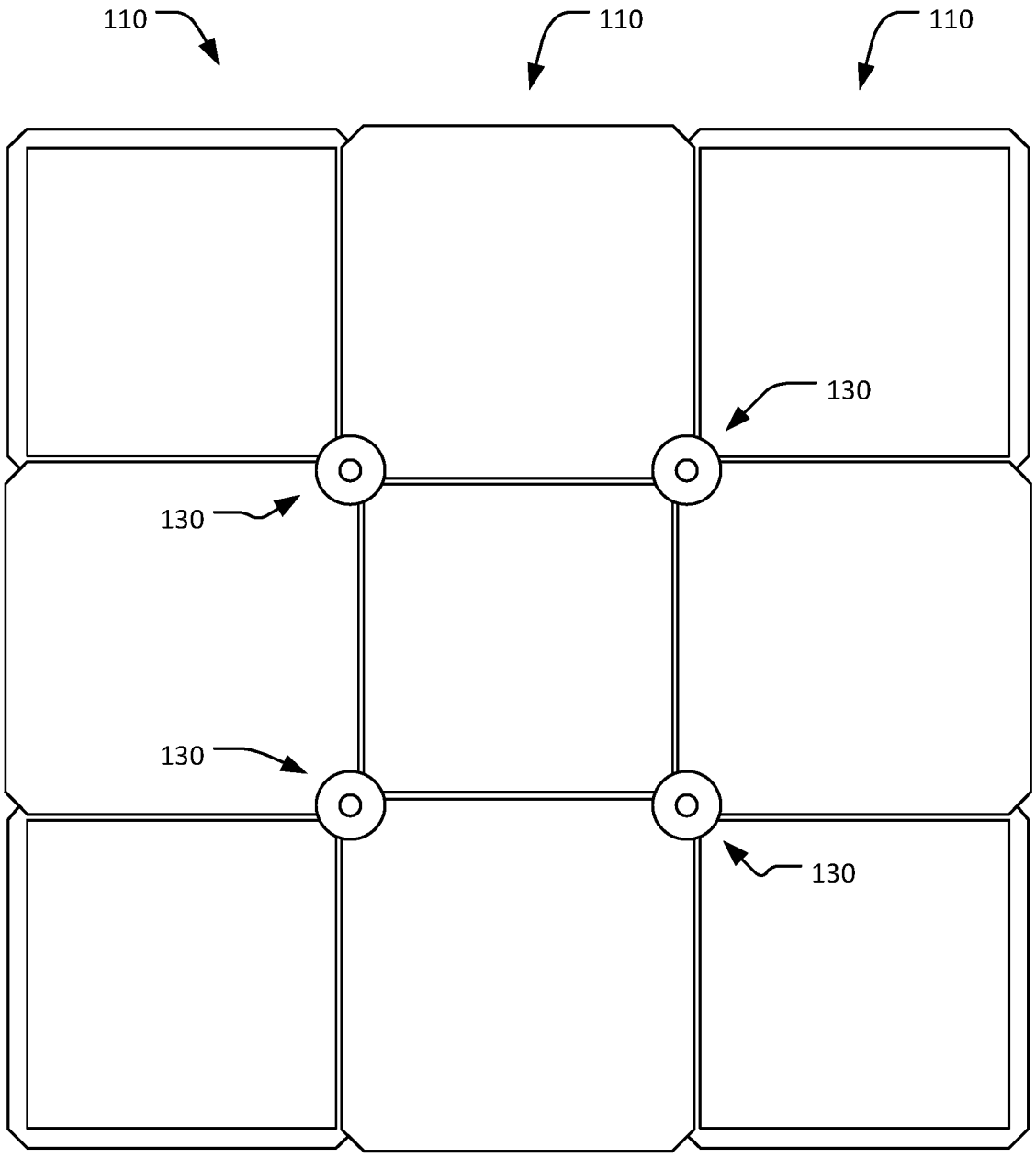
FIG. 4 is a front view of a system of interlocking tiles according to embodiments of the invention.
Figure 5A:
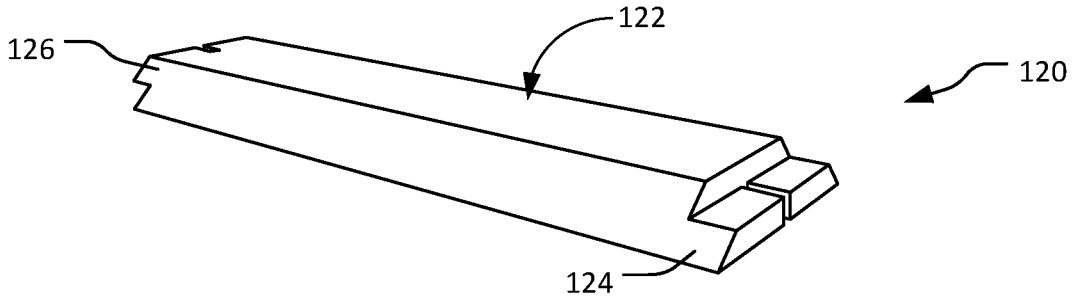
FIG. 5A is a perspective view of an interlocking corner tile according to embodiments of the invention.
Figure 5B:
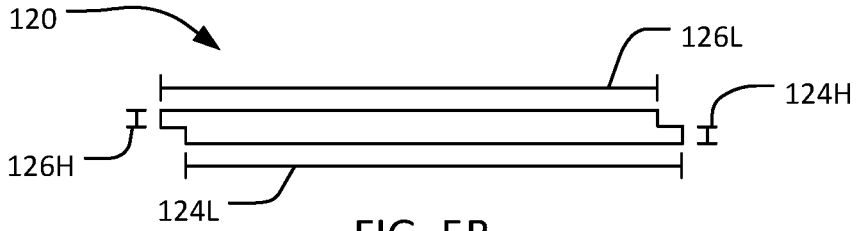
FIG. 5B is a side view of the corner tile of FIG. 5A.
Figure 5C:
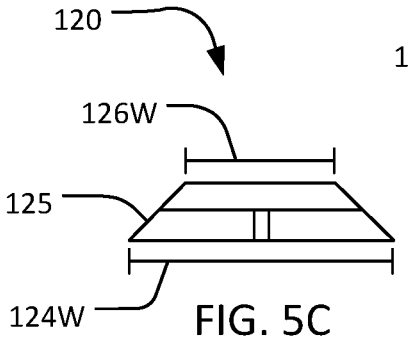
FIG. 5C is an end view of the corner tile of FIG. 5A.
Figure 5D:
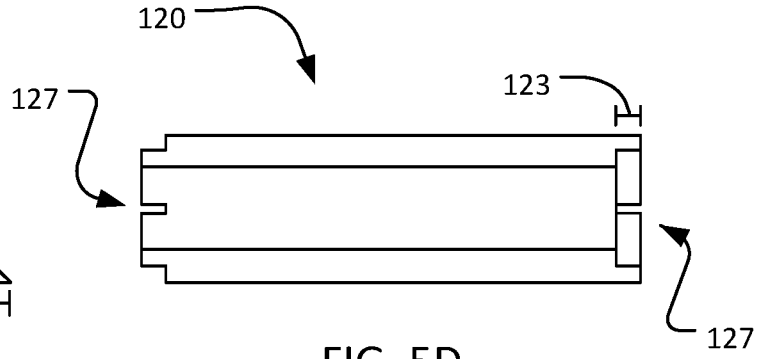
FIG. 5D is a front view of the corner tile of FIG. 5A.

As shown in FIG. 4, to secure the tile to the surface 50, a first tile 110 is positioned such that the flange 114 on opposing sides overlaps respective channels 132. A second tile 110, is situated adjacent the first tile 110 in a reverse configuration such that the flanges 114 overlap and "interlock" as described herein. Additional tiles 110 are added to the surface 50 in an interlocking manner until the surface 50 is covered. When appropriate, bolts 134, optionally having a washer 136, may be inserted through the openings 119 defined between corresponding tiles 110 and through respective apertures in the channel 132 to secure the tiles 110 to the channel 132. Thus, by sandwiching the interlocking tile 110 between the channel 132 and the bolt 134 (and optionally with a washer 136), the tile 110 may be retained to the wall 50. In embodiments, a plurality of tiles 100 may be retained at the same time by a single bolt 134, optionally together with a washer 136. For example, as illustrated in FIG. 4, a bolt 134, and optionally washer 136, may be located at the intersection of four tiles 110, and thus the bolt 134 (and washer 136) may act to retain all four tiles 110 simultaneously. Of course, bolts 134, optionally with washers 136, may additionally be located at corners of tiles 110 that do not have an adjacent tile 110 to maintain the tile 110 in position. Because of the chamfered corners of the wall tiles 110 (or the corners being devoid of the flange 114) the bolt 134 does not pierce the tile 110 when in an installed configuration. Rather, as noted above, the bolt 134 is received into the opening 119 between respective tiles 110.

At the junction of perpendicular surfaces (e.g., between a wall and the ceiling or between respective walls) it may be difficult to ensure a tight fit between tiles and therefore there is a risk of damage if the fire reaches behind the tiles to the surface. FIGS. 5A-5D depict a corner tile 120 specifically designed to protect the area between perpendicular surfaces. The corner tile 120 has a body 122, with a lower portion 124 and an upper portion 126. The corner tiles 120 may be configured to fit within a corner of two or more surfaces, as shown in FIGS. 7A-7C. Accordingly, the corner tile 120 may have an upper portion width 126W that is less than a width 124W of the lower portion 124. This may result in a corner tile 120 with one or more angled edges 125. The angled edge 125 may be configured to fit within any corner between two surfaces. The corner tiles 120 may have a slot 127 at each end to receive the bolts 134 of the bracket system 130 for securing to a surface (FIG. 8).

Figure 6A:
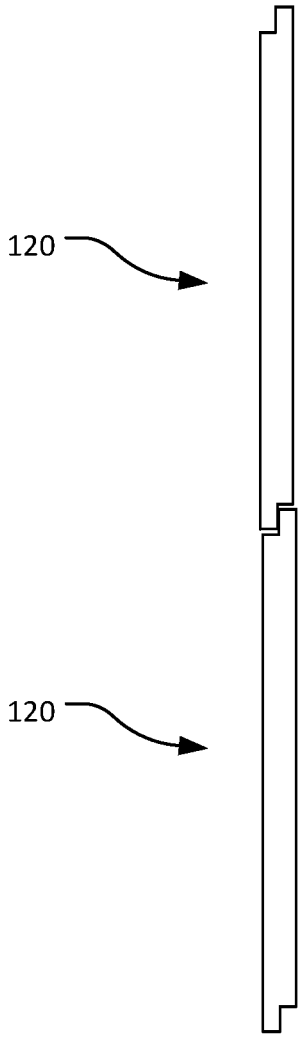
FIG. 6A is a side view of overlapping corner tiles according to embodiments of the invention.
Figure 6B:
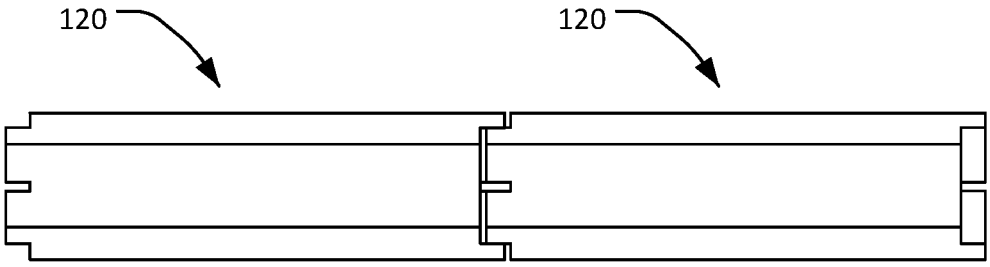
FIG. 6B is a front view of the overlapping corner tiles of FIG. 6A.

The corner tile 120 may have a lower portion height 124H that is substantially similar to the upper portion height 126H. The upper 126 and lower 124 portions of the corner tiles 120 may be horizontally offset from each other. That is to say, the upper portion 126 may have a length 126L that is substantially the same as a length 124L of the lower portion 124, but the upper portion 126 may be offset from the lower portion 124 by a corner tile offset 123. In this way, a plurality of corner tiles 120 may be placed end to end in an overlapping manner and secured to a surface (e.g., a wall 50, a ceiling, etc.), as shown in FIGS. 6A-6B. In embodiments, the lengths 124L and 126L of the corner tile 120 may be about fifteen inches, and the corner tile offset 123 may be about one inch. Also like the wall tiles 110, the corner tiles 120 may have fire protection properties, and may be cast or molded into form.

The corner tiles 120 may be secured to the surface (e.g., one or more walls 50) much in the same way as the wall tiles 110 (e.g., via channels 132, fasteners 133, bolts 134, and washers 136). In embodiments, the corner tiles 120 may use a corner channel 138 instead of a channel 132. The corner channel 138 may span across two or more walls 50. When secured to the walls 50, the corner tile 20 may abut the corner channel 138 (FIG. 7B), thus sandwiching the corner tile 120 between the washers 136 and the walls 50. Alternatively, the corner tile 120 may abut two or more wall tiles 110 (FIG. 7C), thus sandwiching both the corner tile 120 and the wall tiles 110 between the washers 136 and the walls 50.

Figure 11:
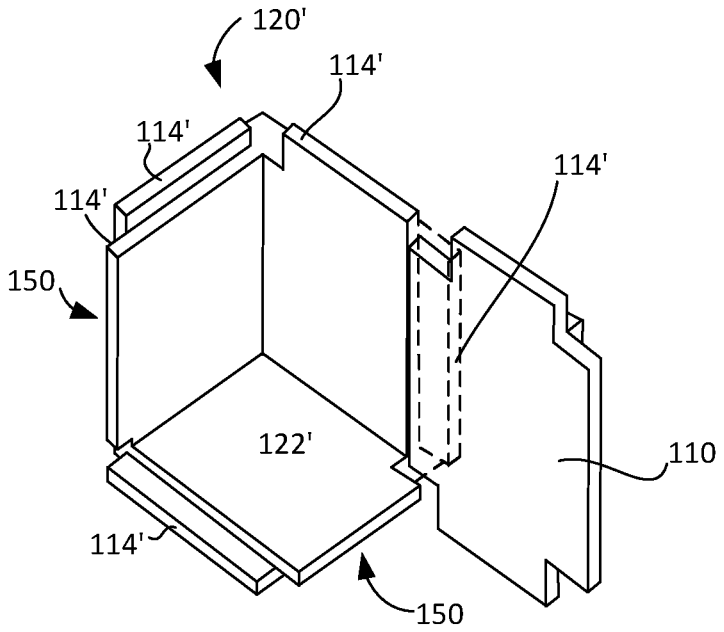
FIG. 11 is a perspective view of a corner tile of FIG. 10A in use with a wall tile according to embodiments of the invention.

An alternative embodiment of a corner tile 120' is illustrated in FIGS. 10A-10D. Here, the corner 120' has more of a block configuration so as to maintain more of a traditional corner (e.g., non-angled). Like the wall tiles 110, the corner tile 120' has a plurality of flanges 114' extending from the main body 122'. The flanges 114' alternately extend from the main body 122' to define voids 150 for receiving respective flanges 114 of the wall tiles 110. When installed, the flange 114 of a respective tile 110 is maintained substantially adjacent the respective flange 114' of the corner piece 120', as shown in FIG. 11. The corners 120' may be oriented as a corner piece for the ceiling or the floor, depending on the needs of the room.

By assembling both a plurality of wall tiles 110 and a plurality of corner tiles 120 to a series of walls 50, a fire protected room 140 may be created, as shown in FIG. 9. While the floor of the burn room 140 may be shown here without any tiles 110, 120, alternative embodiments may have tiles 110, 120 along the floor for added protection. FIG. 9 also depicts non-uniform wall spaces, such as a window 60 and a door 70. To accommodate these non-uniform spaces, the tiles 110, 120 may be modified. For example, wall tiles 120 may be machined, molded, or cast in a shape that may fit a window 60 or a door 70. These are depicted in FIG. 9 as modified wall tiles 110'.

One of many advantages of the interlocking tile system 100 is that it may allow a user to assemble or replace a series of tiles 110, 120 relatively quickly compared to the prior art. A wall tile 110 or a corner tile 120 may be removed from the wall 50 by removing each of the adjacent bolts 134 (e.g., four bolts 134 for a typical wall tile 110 and two bolts for a typical corner tile 120). For wall tiles 110 whose upper portion 116 is facing away from the wall 50, a plurality of adjacent tiles 110 may need to be removed since those adjacent tiles are also holding the target tile 110 down. Even so, this replacement process may be significantly faster than a conventional system where the entire wall of conventional tiles may have to be taken down in order to replace a single tile.

Another benefit that may stem from the quick installation/replaceability of the system 100 is that the tiles 110, 120 may be made smaller than conventional systems. Because of how long it takes to install or replace conventional tile systems, conventional tiles are incentivized to be made larger, since this would reduce the total number of tiles that would have to installed or uninstalled at a given time. However, these larger tiles suffer from having a greater amount of expansion and contraction due to the high temperatures fire protection tile systems are subjected to. Because each of the tiles in the system 100 may be smaller than the conventional tiles, the system 100 tiles may experience less damages resulting from expansion/contraction of the tiles under extreme temperatures as compared to conventional tiles.

Yet another advantage of the inverted shiplap design of the tiles 110 is that the tiles 110 may be reused by flipping the tile 110 over and reinstalling it. The interlocking nature of the tiles 110 allow the tiles 110 to be used in a versatile manner where any one tile 110 may be interchanged with another tile 110 if it is so desired.

While the disclosure focuses on burn rooms, the artisan will understand from the disclosure herein that the interlocking tile system 100 may likewise be used in other applications (e.g., regular building insulation and protection, fire protected safes, et cetera).

Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure. It will be understood that certain features and subcombinations are of utility and may be employed without reference to other features and subcombinations and are contemplated within the scope of the present disclosure.

The disclosure claimed is:

1. A tile system for a burn room, comprising:

a plurality of interlocking surface tiles, each surface tile comprising an upper portion and a lower portion, the lower portion extending beyond at least a portion of a perimeter of the upper portion to define a flange;

a plurality of interlocking corner tiles, each corner tile being configured to abut at least one of the plurality of surface tiles and to interlock with another of the plurality of corner tiles, wherein each corner tile comprises an upper portion and a lower portion horizontally offset from the upper portion, wherein a length of the upper portion is substantially equal to a length of the lower portion; and a bracket system for securing the plurality of surface tiles and the plurality of corner tiles to a surface.

2. The system of claim 1, wherein the flange extends continuously around the perimeter of the upper portion.

3. The system of claim 2, wherein the flange comprises chamfered corners.

4. The system of claim 1, wherein each corner tile has a generally trapezoidal shape when viewed parallel to a long side of the corner tile.

5. The system of claim 1, wherein each corner tile has a main body with a generally cubical shape comprising three sides, each side comprising at least two offset flanges extending from the main body in perpendicular planes.

6. The system of claim 1, wherein:

the bracket system comprises a plurality of decoupling channels defining a channel grid; and the plurality of surface tiles and corner tiles are secured to the decoupling channels via mechanical fasteners.

7. The system of claim 6, wherein a washer is positioned between the respective surface tile or corner tile and the mechanical fastener.

8. The system of claim 7, wherein the mechanical fastener does not pierce the respective surface tile when in an installed configuration.

9. A burn room, comprising:

a plurality of surface tiles, each surface tile comprising a main body having a top face and a bottom face, and a flange extending substantially around a perimeter of the main body, wherein a bottom face of the flange is level with the bottom face of the main body; and a plurality of corner tiles, each corner tile having an upper portion and a lower portion together defining a top face, a bottom face, opposing angled side faces, and opposing end faces, wherein the corner tile is skewed such that the upper portion extends beyond the lower portion at one of the opposing end faces and the lower portion extends beyond the upper portion at the other of the opposing end faces, and wherein the corner tile has a generally trapezoidal shape when viewed from either of the opposing end faces;

wherein:

each surface tile is configured to be arranged in an upward-facing orientation and a downward-facing orientation;

a first surface tile of the plurality of surface tiles is arranged in the upward-facing orientation in an installed configuration;

a second surface tile of the plurality of surface tiles is arranged in the downward-facing orientation in the installed configuration;

in the installed configuration, the flange of the first surface tile is substantially adjacent the flange of the second surface tile;

in an installed configuration, the upper portion of a first of the plurality of corner tiles is substantially adjacent the lower portion of a second of the plurality of corner tiles, and each opposing angled side face of the first and second corner tiles is substantially adjacent a respective face of a respective surface tile.

10. The burn room of claim 9, wherein the flange extends continuously around the main body of each surface tile.

11. The burn room of claim 10, wherein the flange comprises chamfered corners.

12. The burn room of claim 9, wherein each of the upper portion and the lower portion of each corner tile comprises a slot for receiving a fastening mechanism.

13. The burn room of claim 12, wherein a length of the upper portion extending beyond the lower portion is substantially equal to a length of the lower portion extending beyond the upper portion.

14. The burn room of claim 9, wherein, in the installed configuration, openings are defined between adjacent surface tiles for receiving a fastening mechanism.

15. A method of assembling a burn room, comprising:

(a) providing a plurality of interlocking surface tiles, each surface tile comprising a main body having a top face and a bottom face and a flange extending substantially around a perimeter of the main body, wherein a bottom face of the flange is level with the bottom face of the main body;

(b) positioning a first surface tile of the plurality of surface tiles substantially adjacent a surface in an upward facing orientation; and (c) positioning a second surface tile of the plurality of surface tiles substantially adjacent the surface and the first surface tile in a downward facing orientation, wherein, when the second surface tile is positioned substantially adjacent the first surface tile, the flange of the second surface tile at least partially overlaps the flange of the first surface tile;

(d) providing a plurality of corner tiles, each corner tile comprising an upper portion and a lower portion together defining a top face, a bottom face, opposing angled side faces, and opposing end faces, wherein the corner tile is skewed such that the upper portion extends beyond the lower portion at one of the opposing end faces and the lower portion extends beyond the upper portion at the other of the opposing end faces;

(e) positioning a first of the plurality of corner tiles such that one of the opposing angled side faces is generally adjacent a respective face of one of the plurality of surface tiles and the other of the opposing angled side faces is generally adjacent a respective face of another of the plurality of surface tiles thereby defining a corner;

(f) positioning a second of the plurality of corner tiles adjacent the first of the plurality of corner tiles such that the lower portion of the first of the plurality of corner tiles is substantially adjacent the upper portion of the second of the plurality of corner tiles.

16. The method of claim 15, further comprising:

(d) repeating steps (b), (c), (e), and (f) until the surface is covered.

17. The method of claim 15, further comprising:

(d) positioning a third tile of the plurality of tiles substantially adjacent the surface and the second tile in an upwardly facing orientation, wherein the flange of the second tile at least partially overlaps the flange of the third tile.

18. The method of claim 17, further comprising:

(e) repeating steps (b)-(d) and (e)-(f) until the surface is covered.

19. The method of claim 15, further comprising a bracket system comprising a plurality of decoupling channels defining a grid, wherein each of the plurality of decoupling channels is situated between the surface and the plurality of interlocking surface tiles.

* * * * *